US006742200B2

(12) United States Patent
T.

(10) Patent No.: US 6,742,200 B2
(45) Date of Patent: Jun. 1, 2004

(54) BED SOFA

(76) Inventor: Luis Armando Quiñones T., Comdibar, Carrera 2 Con Calle 4, Barquisimeto, Estado Lara (VE)

( * ) Notice: Subject to any disclaimer, the term of this patent is extended or adjusted under 35 U.S.C. 154(b) by 0 days.

(21) Appl. No.: 10/155,181

(22) Filed: May 28, 2002

(65) Prior Publication Data

US 2003/0221255 A1 Dec. 4, 2003

(51) Int. Cl.[7] ..... A47C 17/04
(52) U.S. Cl. ..... 5/37.1; 5/47; 5/12.1; 5/38
(58) Field of Search ..... 5/37.1, 47, 12.11, 5/38, 39, 57.1

(56) References Cited

U.S. PATENT DOCUMENTS 569,679 A * 10/1896 Stokes ..... 5/38
624,591 A * 5/1899 Weyer ..... 5/38
5,860,702 A * 1/1999 Pilarczyk et al. ..... 297/354.13
5,904,401 A * 5/1999 Alberda et al. ..... 297/354.13
6,463,602 B1 * 10/2002 Patella ..... 5/12.1

* cited by examiner

*Primary Examiner*—Teri Pham Luu
(74) *Attorney, Agent, or Firm*—Dennison, Schultz, Dougherty & MacDonald

(57) ABSTRACT

This invention relates to convertible furniture. Particularly, it refers to a novel folding mechanism for a bed-sofa, characterized by comprising a two portions structure both corresponding to a seat and a back or to form a flat surface for a bed, comprising such mechanism elongated platens, sliding and fixing plates, folding hinges and a pair of frames or structures corresponding to each one of said portions.

4 Claims, 8 Drawing Sheets

BED SOFA

FIELD OF THE INVENTION

This invention relates to convertible furniture. In particular, to a bed sofa capable to be transformed from a bed to a sofa and viceversa.

BACKGROUND OF THE INVENTION

Several devices designed to convert a bed into a sofa and viceversa are known. The U.S. Pat. No. 2,954,567 granted to Aram Christian Abajiam comprises three triangular frames, one of them stationary, which operates as the bed-sofa seat and the two other ones are joined in the bed-sofa upper center defining the back and the end support of said bed-sofa, providing flat supports on the assembly lower portion. Another prior art device is disclosed in the U.S. Pat. No. 4,239,281 granted to Sebastiano Lucas, referring to a moveable articulated frame comprising three sub-structures where the first one pivots on one of the main frame ends, being the second into the stationary portion by joints and risers attached to the first sub-structure, which also is connected to said first sub-structure when the mechanism is open outwardly as a bed; the first sub-structure is rotated toward a horizontal position and the second sub-structure is risen to the same horizontal position level and therefore, the jointing and rising systems remain suspended. This patent as compared to the present invention, comprises many structural elements and a very bulky, complex and expensive mechanism. The U.S. Pat. No. 2,136,320 granted to Robert Schwab provides a bar mechanism (crankshaft-connecting rod) and springs allowing a partial backward sliding of the seat and a backward rotation of the back, providing a sole horizontal surface between the seat and the back, at the same level. On the upper part of the seat structure portion is provided a front wheel which upon rotating the back, the estructure moves backward and retracts on the place occupied by the seat. A mechanism operates between the intermediate and upper portion of the bed-sofa. This system comprises a sophisticated element group to perform a sofa but cannot be disassembled, for example, to pile up the back on the seat in order to facilitate packing and shipping as in the present invention.

DETAILED DESCRIPTION OF THE INVENTION

Figure 11:
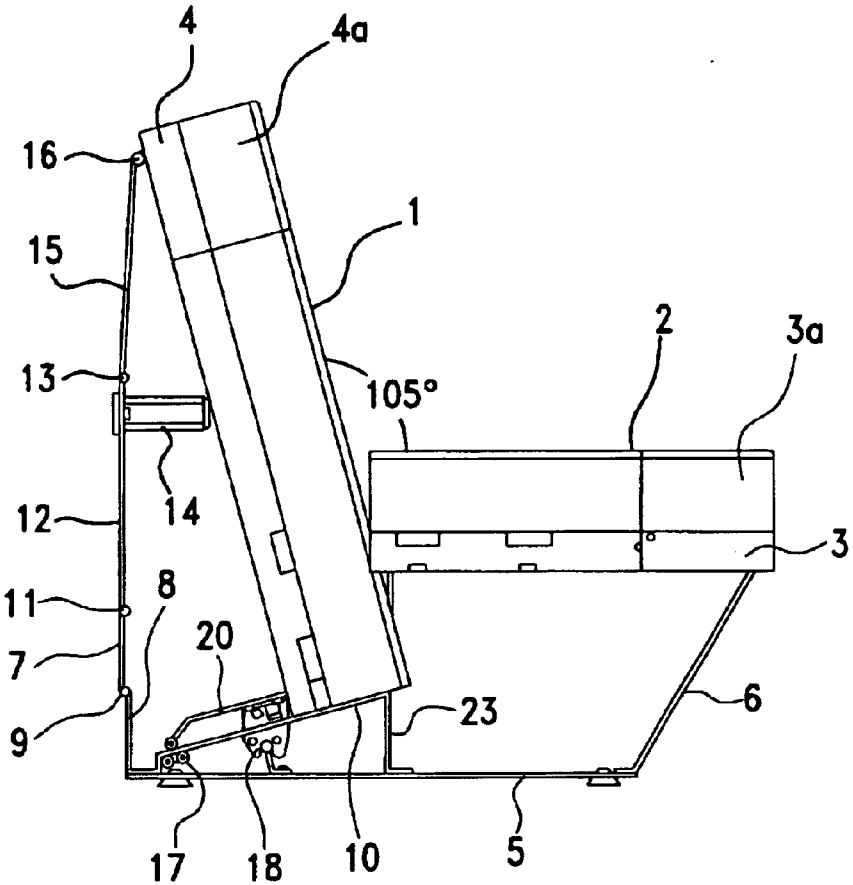
FIG. 11 is a side end view of the bed-sofa shown as a sofa.
Figure 12:
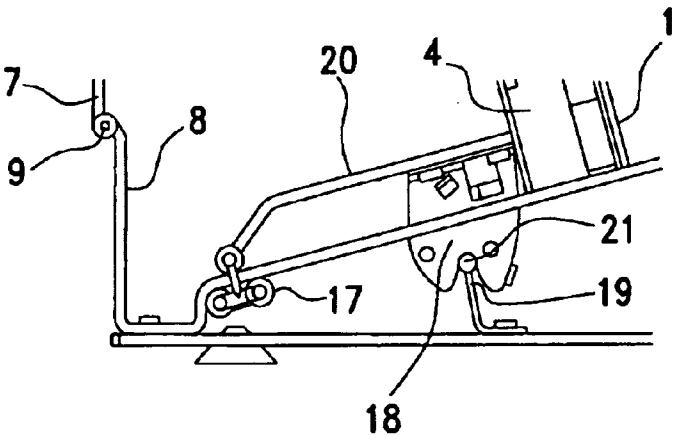
FIG. 12 is an enlarged detail of the mechanism shown encircled in FIG. 11.

As can be seen in the above referred drawings, the bed-sofa assembly is essentially defined by two portions where one (1) of them is moveable and the other (2) is foreseen to be in a stationary condition. As 'sofa' (see FIG. 11), the movable portion 1 operates as a back and the stationary portion 2 determines the bed-sofa seat.

Figure 1:
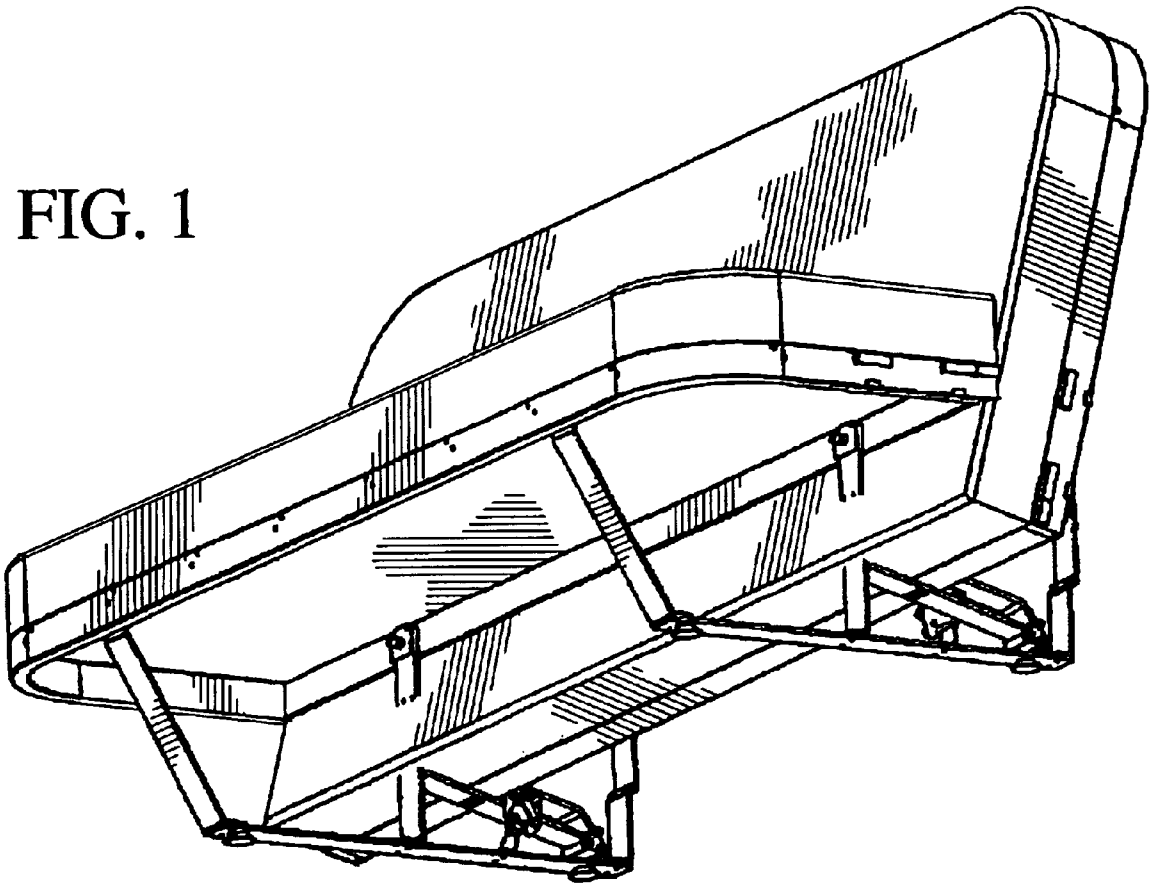
FIG. 1 is an isometric view of the bed-sofa observed from its lower portion and in the sofa position.
Figure 2:
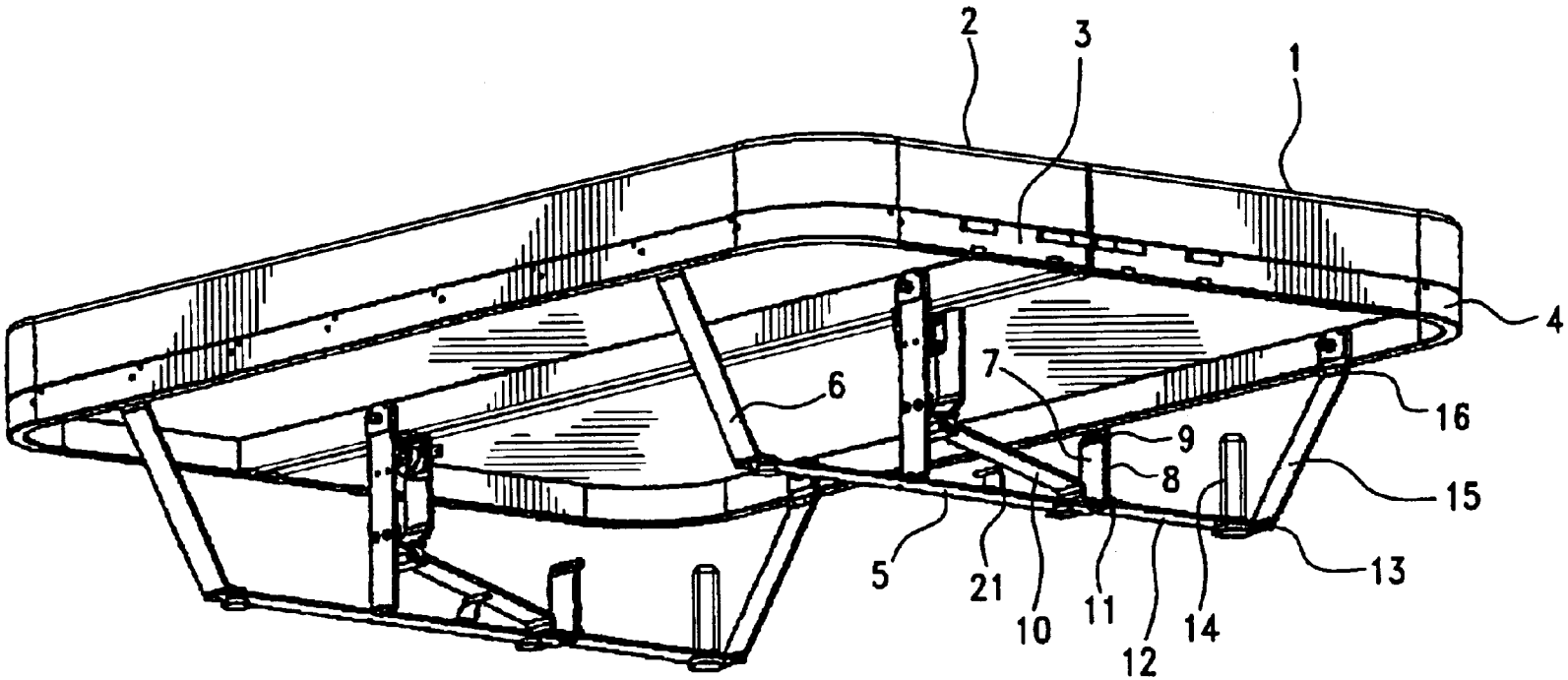
FIG. 2 is a view similar to FIG. 1 but in the bed position.
Figure 3:
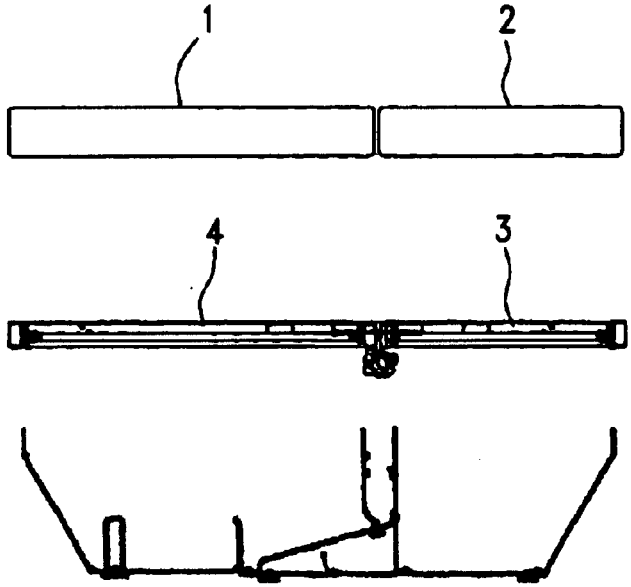
FIG. 3 is an exploded view of the bed-sofa essential parts observed from an end and in the bed position.
Figure 4:
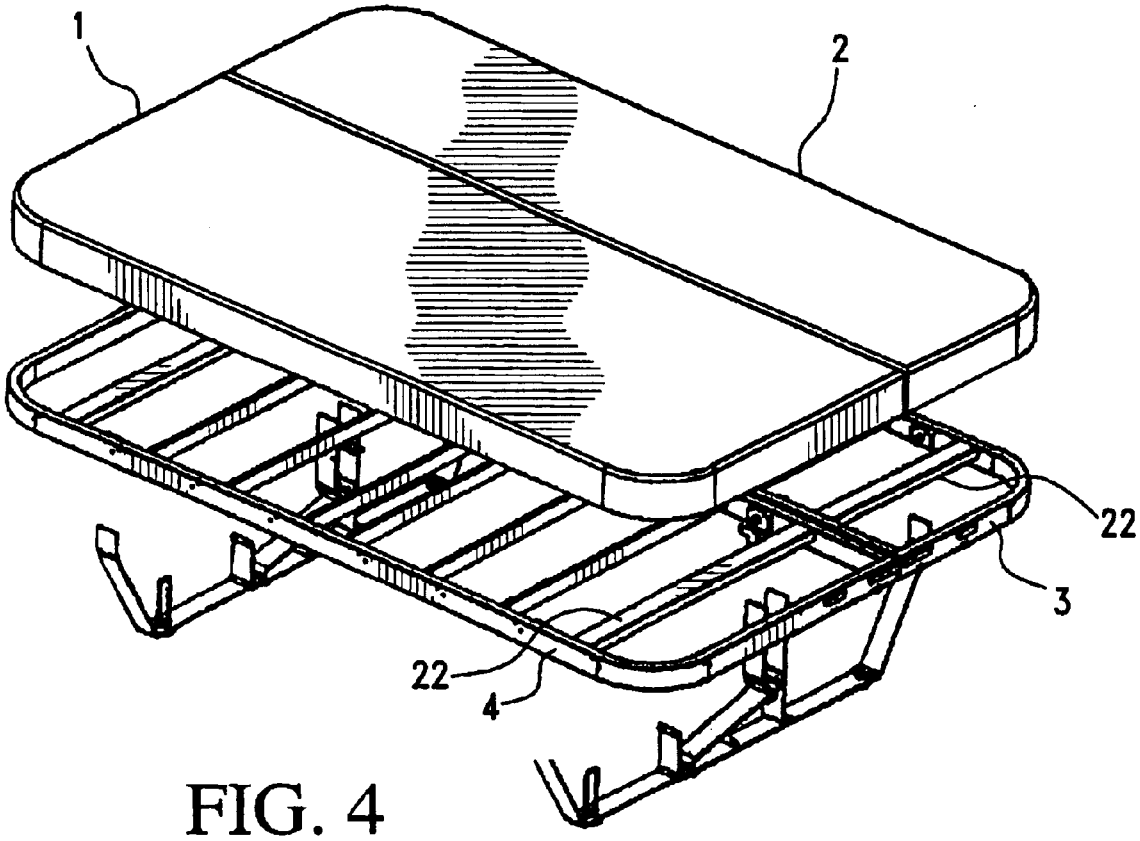
FIG. 4 is a view similar to FIG. 3, shown isometrically.
Figure 5:
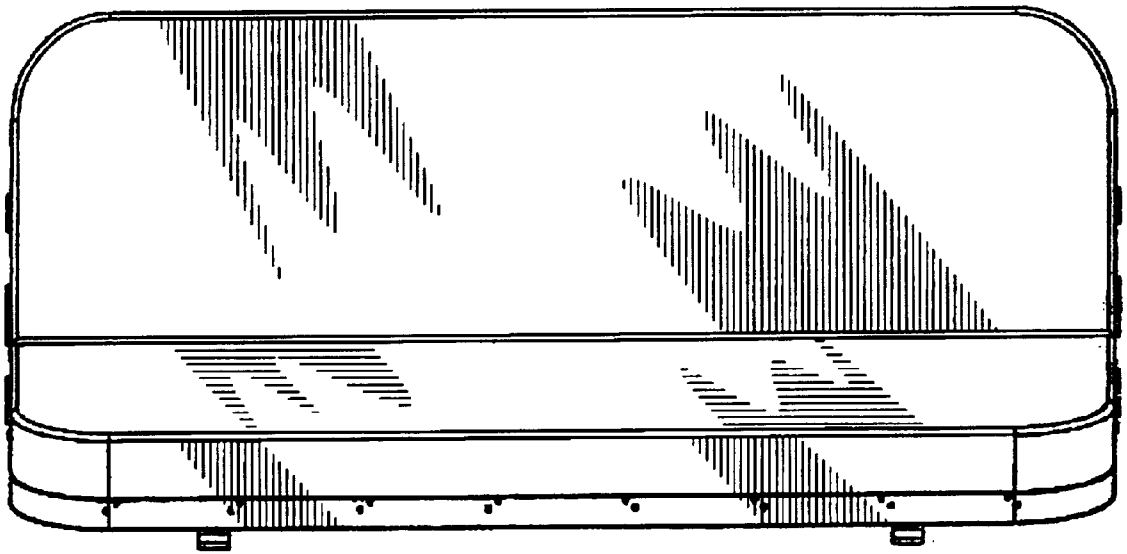
FIG. 5 is an isometric front view of the bed-sofa assembly in a sofa position.
Figure 6:
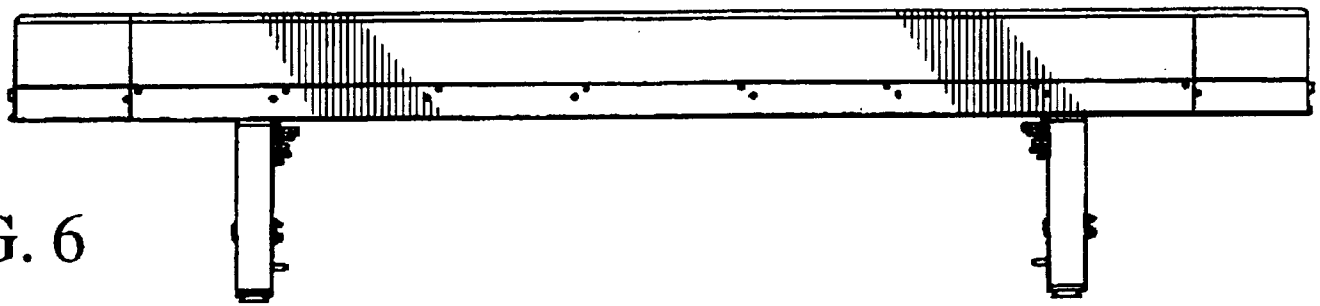
FIG. 6 is a longitudinal side view of the bed-sofa assembly in a sofa position.
Figure 7:
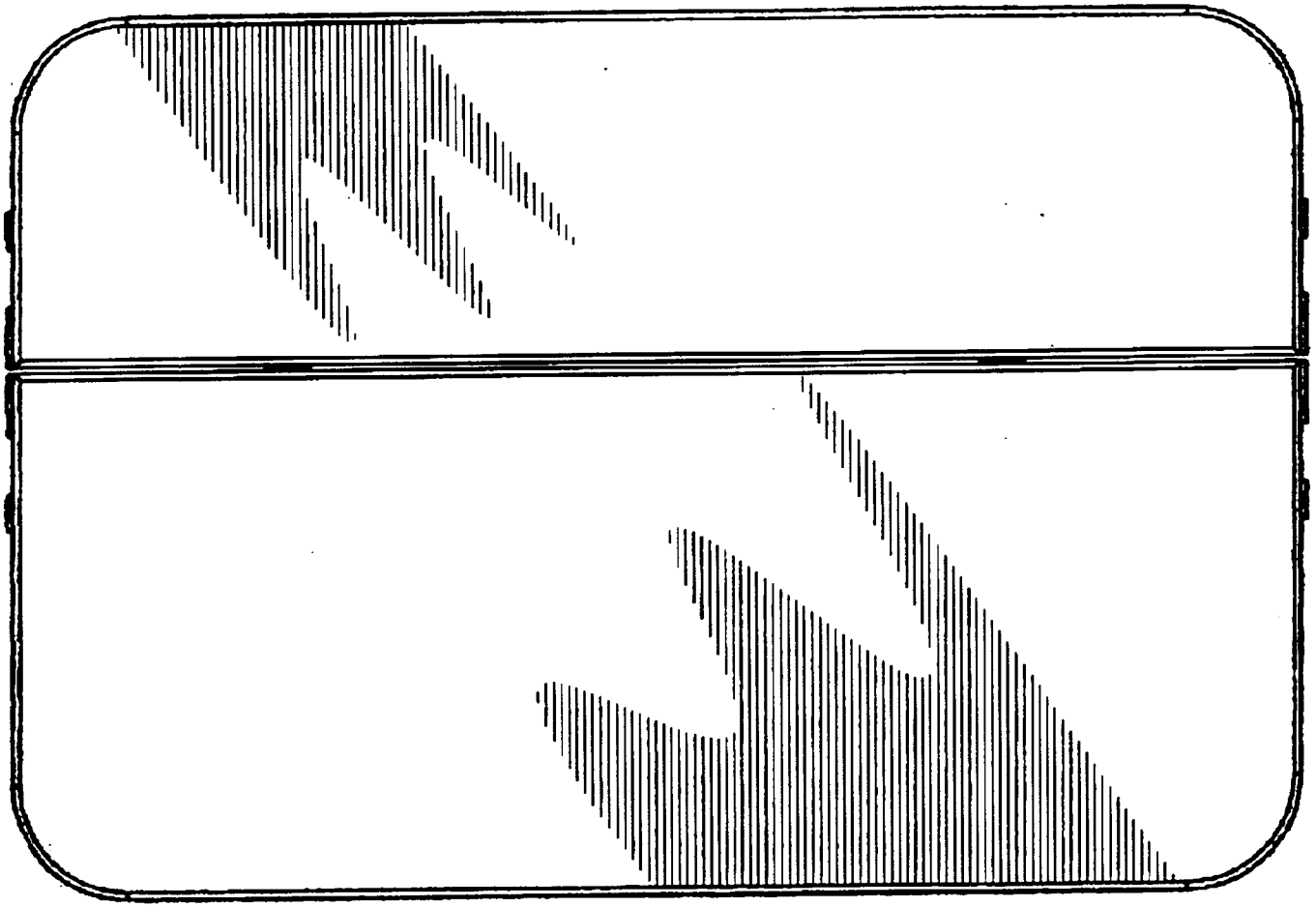
FIG. 7 is a top view of the bed-sofa.

Each portion 1 and 2 is constituted by corresponding structures formed by frames 4 and 3, respectively, having crosspieces 22 (FIG. 4) where are supported structures 4*a* and 3*a* comprising cushioned surfaces as usual.

Figure 9:
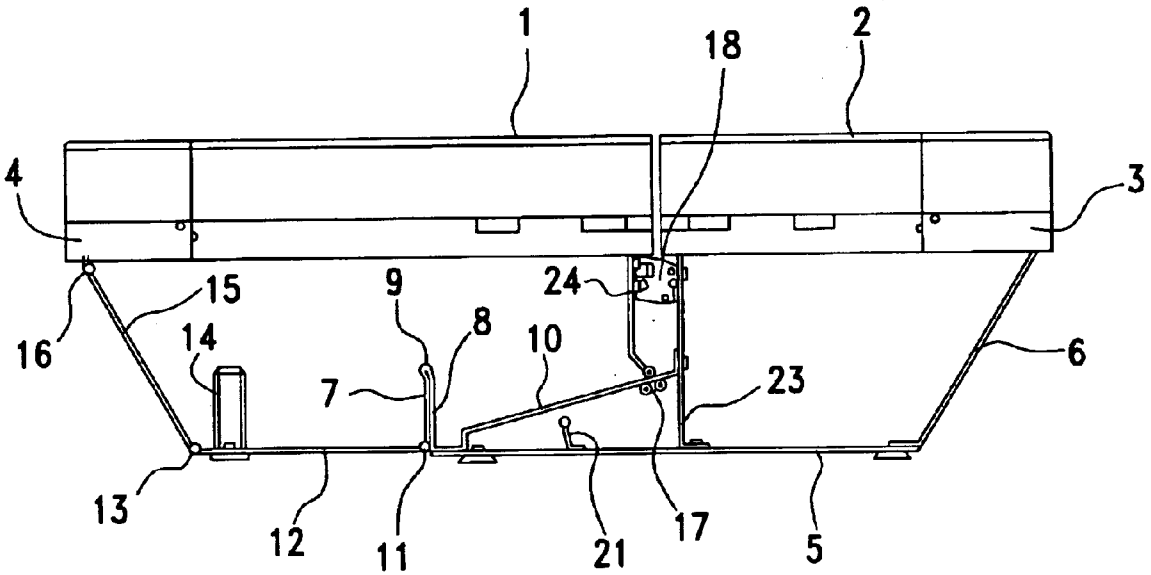
FIG. 9 is a view similar to FIG. 3, showing the assembled bed-sofa elements.
Figure 10:
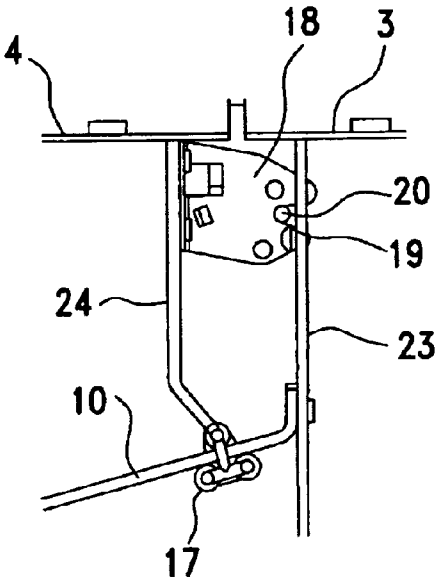
FIG. 10 is an enlarged detail of the mechanism shown encircled in FIG. 9.

Referring now to FIGS. 9 and 10, which show details of the assembly support and conversion mechanism to perform a change from a position to other, it can be seen a structure formed by a base platen 5 connected to a side tilted platen 6. On platen 5 there is a vertical platen 23 having a protruding lug 20 where fits and seats a movable platen 18 by way of a slot 19. In the same way, the platen 5 is incorporated to a protruding lug 21 to engage a platen 18 in another portion thereof. A platen 10, as a prop, joints the vertical platen 23 to the platen 5, also operating as an inclined plane for sliding surrounding rolls 17 connected to a bent vertical platen 24 incorporated to the movable platen 18. Platen 10 is provided at its lower end with a vertical extension 8 having a hinge 9 attached to a movable platen 7 with a lower hinge 11 connected to a platen 12 and this, in turn, to a hinge 13, a platen 15 and a hinge 16. On the platen 12 is provided a top 14.

The platen 6 and support 23 are joined, through bolts (not shown), to the frame 3, and platen 15 and hinge 16 to the frame 4. Therefore, those elements can be disassembled, if necessary.

Now then and considering a position of the device as a bed, as shown in FIG. 9, the platen 18 is fitted on a protruding lug 20, the vertical bent platen 24 is parallel to support 23, rolls 17 are at the inclined plane 10, platens 7 and 8 are joined side to side by way of a hinge 9 and platens 12 and 15 determine an open angle with the hinge 13 at the angle apex formed defining a stable structure.

In order to perform a sofa position (FIG. 11) it should be enough a side upperward thrust promoting the plate 18 disengages from the protruding lug 20 and simultaneously rolls 17 will slide on the inclined plane 10. Such movement will carry out the platen 7 opens about 180° and vertically aligned to platens 12 and 15; during such movement, platen 18 will have reached the lug 21 where fits into a slot 19 and this position coincides to a maximum position of the back, which is about 105° relative to the horizontal plane. Platen 12 places top 14 horizontally supporting it against frame 4 strengthening the structure of the back of the sofa.

It should be obvious that in order to return to a bed position, it will be sufficient to thrust the back 1 downward on the top edge to disengage the plate 18 from the lug 21 and the remaining components will perform simultaneously an inverse movement than the above explained.

Figure 8:
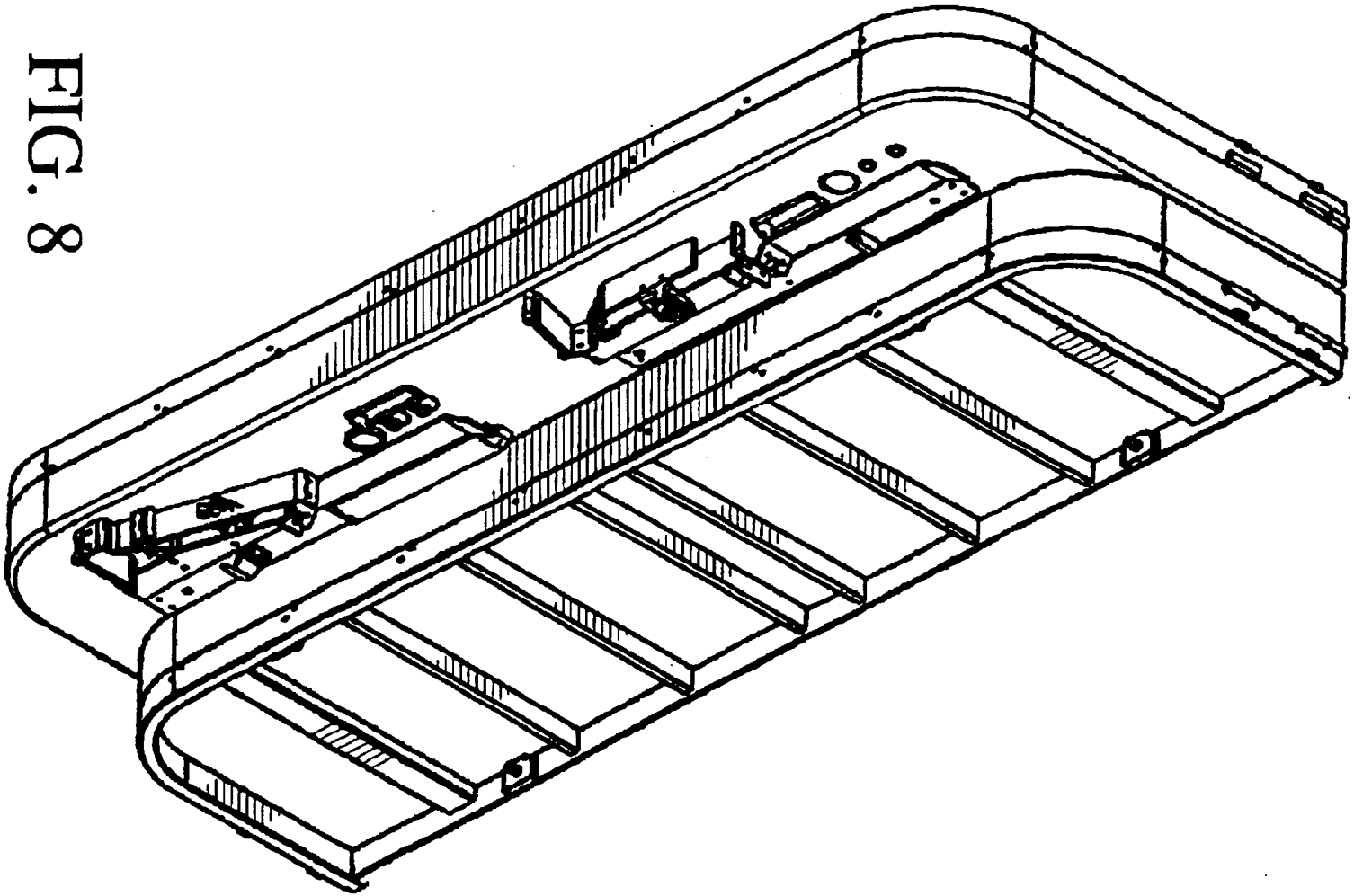
FIG. 8 is an isometric view of the bed-sofa in an overlapped condition, showing a stepped space to receive the mechanical parts of the device, disassembled, to facilitate packing and shipping.

As stated before all the support/mechanism structure is screwed to frames 3 and 4, as well as between its main parts, which is an advantageous feature due to allows disassembling. As shown in FIG. 8 once the device is disassembled and placed the piece 2 over the piece 1, a stepped place is formed due to width differences between them permitting to arrange all mechanical components on such place, facilitating packing and shipping the device into a box or other suitable container.

What is claimed is:

1. A bed-sofa assembly, comprising:

a stationary portion and a movable portion wherein said movable portion includes a fitting movable plate having a vertical platen with rolls which slide on an inclined plane in first and second directions as well as hinged platens combined to said movable plate.

2. A bed-sofa assembly according to claim 1, wherein such fitting movable plate comprises a fitting slot to fit in a lug for locking the bed-sofa assembly in a bed position or in another lug for locking the device in a sofa position.

3. A bed-sofa assembly, according to claim 1, wherein the fitting movable plate is joined to a second platen having end rolls which slide on an inclined plane, wherein said rolls and said inclined plane operates as controlled guide means in displacing the bed-sofa assembly back.

4. A bed-sofa assembly, according to claim 1, wherein the bed-sofa assembly can be disassembled to facilitate packing and shipping and once disassembled said assembly said stationary portion and said movable portion can be put over to provide a placing space for the disassembled bed-sofa assembly.

* * * * *